US005507347A

United States Patent [19]

Estilette, Sr.

[11] Patent Number: 5,507,347

[45] Date of Patent: Apr. 16, 1996

[54] METHOD AND APPARATUS FOR JARRING

[76] Inventor: Felix F. Estilette, Sr., P.O. Box 39, Carencro, La. 70520

[21] Appl. No.: 295,213

[22] Filed: Aug. 24, 1994

[51] Int. Cl.[6] ..... E21B 31/107

[52] U.S. Cl. ..... 166/301; 166/178; 175/296

[58] Field of Search ..... 166/301, 178; 175/296, 300, 302

[56] References Cited

U.S. PATENT DOCUMENTS

| | | | |
|---|---|---|---|
| 2,122,751 | 7/1938 | Phipps | 255/27 |
| 3,203,482 | 8/1965 | Lyles | 166/178 |
| 4,333,542 | 6/1982 | Taylor | 175/299 |
| 4,844,157 | 7/1989 | Taylor | 166/178 |
| 4,846,273 | 7/1989 | Anderson et al. | 166/178 |
| 5,139,086 | 8/1992 | Griffith | 166/178 |
| 5,327,982 | 7/1994 | Trahan et al. | 166/178 X |

*Primary Examiner*—William P. Neuder
*Attorney, Agent, or Firm*—C. Dean Domingue

[57] ABSTRACT

A method and apparatus for jarring an object in a wellbore is disclosed. Generally, the apparatus contains a body member having an inner and outer diameter, an operator mandrel slidably disposed within the inner diameter of the body member, and a selective attachment member for selectively attaching and detaching the operator mandrel to the body member. The apparatus may also contain a mechanism to reset the operator mandrel with the body member when the operator mandrel has been released.

9 Claims, 8 Drawing Sheets

METHOD AND APPARATUS FOR JARRING

BACKGROUND OF THE INVENTION

The invention relates to a device used in wellbores. More particularly, but not by way of limitation, the invention relates to a downhole device used to deliver a jarring impact to objects within a wellbore.

In order to produce hydrocarbons, a wellbore is drilled until a subterranean reservoir is encountered. Once the drilling of the wellbore has been completed, a casing string may be run into the wellbore, and then cemented into place. As is understood by those of ordinary skill in the art, the subterranean reservoir can then be perforated to allow communication between the reservoir and the casing. Thereafter, the well may be completed, for instance, with the placement of gravel pack and a gravel pack screen. The well is then capable of producing the hydrocarbons.

For the drilling and completing of the wellbores to the hydrocarbon reservoirs, different types of drill and completion strings may be employed. Historically, a drill string made up of a series of coupled drill pipe has been employed for rotary drilling. Recently, coiled tubing has been utilized for both the drilling and completion phase. The coiled tubing is generally of a smaller diameter tubular as compared to drill pipe, and moreover, is continuous e.g. lacks interconnecting tool joints. It should also be understood that the invention described herein is applicable to drill pipe, coiled tubing and other types of workstrings such as wireline and electric line.

During the course of drilling, completing and producing the hydrocarbon reservoir, objects may become stuck within the wellbore. Stuck objects within the wellbores are sometimes referred to as "fish" In order to loosen these objects, jars have been developed that have the effect of providing a jolting impact to the object. Moreover, many wells being drilled include highly deviated and horizontal wells. During the course of drilling these wells, jarring impacts to the bottom hole assembly may be necessary in order to release the objects. Also, it may be necessary to set or unseat certain bottom hole assembly devices by providing jarring impacts. The invention described herein is applicable to all the above situations.

Several prior art jars have been developed. One of the first jars invented for use in wellbores was U.S. Pat. No. 2,122,751 to J. T. Phipps in 1938. Other prior art devices include U.S. Pat. No. 3,203,482 to C. R. Lyles in 1965, U.S. Pat. No. 4,333,542 to W. T. Taylor in 1982, and U.S. Pat. No. 5,139,086 to J. M. Griffith.

Despite these prior art devices, problems exist. The prior art devices suffer from not being able to accurately and dependably deliver the force required. This can result from the type of spring employed in many prior art devices. For instance, frustoconical bellville washers can flatten due to use, and the amount of force required to activate the jar can lessens with repeated use. Also, coiled springs can break, completely disrupting the operation of the jar.

Therefore, there is a need for a jar that will have dependable and reliable predetermined amount of force that will activate the jar to cause an impact force on an object in the well.

SUMMARY OF THE INVENTION

The invention of the present application contains both method and apparatus claims. The application discloses an apparatus for providing a jarring action to an object in a wellbore comprising a body member having an inner and outer diameter; and, an operator mandrel slidably disposed within the inner diameter of the body member. The apparatus further contains selective attachment means for attaching the operator mandrel to the body member; and resetting means, located on said operator mandrel, for resetting the operator mandrel with the body member when the operator mandrel has been detached from the body member.

In one embodiment, the body member may contain a first end and a second end, and wherein the second end is connected to the object in the wellbore, and the operator mandrel is connected to a workstring capable of transmitting a longitudinal force to the operator mandrel.

The selective attachment and detachment means of the present invention may comprise a latch member; a collet member slidably disposed about the operator mandrel, with the collet member containing a catch member that cooperates and engages with said latch member; and spring means, connected to the latch member, for urging the latch member into attachment with the catch member.

The apparatus may contain a groove section on the operator mandrel, and the detaching means will further include that the groove section is sized to accommodate the catch member of the collet member when the latch is in the detached mode.

In the preferred embodiment, the spring means includes a tubular member disposed within the cylindrical housing, the tubular member having a plurality of longitudinal slots, with the latch member being attached to the tubular member.

The apparatus may further contain spring adjustment means that includes a first cylindrical member disposed about the first end of the spring means; and a second cylindrical member disposed about the second end of the spring means. A calibration means, operably associated with the spring adjustment means, for calibrating the tension in the spring means is also included.

The application also discloses a method of delivering a jarring force to an object in a wellbore. Generally, the steps include lowering into the wellbore a workstring such as wire line or a coiled tubing workstring, with the workstring containing a jarring apparatus. The jarring apparatus contains a cylindrical housing, with the cylindrical housing having a first end capable of engaging the object, and the cylindrical housing further having a shoulder providing an anvil surface. The apparatus further contains a power mandrel disposed within the cylindrical housing, the mandrel being threadedly connected to the workstring, as well as the power mandrel containing a section having a reduced outer diameter.

The apparatus used will further contain means for selectively connecting the housing with the operator mandrel, the selective means comprising a latch member; biasing means for biasing the latch member in a first direction; a collet member slidably disposed about the operator mandrel, the collet member having a catch member, with the catch member engaging the latch member.

The steps will include engaging the object with the first end of the housing, and thereafter exerting an upward longitudinal force on the workstring so that the force is transmitted to the power mandrel. Next, the latch member and catch member are engaged so that the housing is latched onto the operator mandrel. The operator must continue to exert a longitudinal force until a predetermined amount of force has been applied to the latch member to cause the biasing means to move in a radial direction thereby disengaging the latch member from the catch member; and thereafter impacting the object by having the hammer strike the anvil.

The method may further comprise the steps of lowering the workstring so that the catch member engages the latch member; and then exerting a downward force so that the catch member is guided into the reduced diameter portion on the power mandrel thereby allowing the catch member past the latch member.

The method may thereafter comprise the steps of exerting an upward longitudinal force on the workstring so that the force is transmitted to said power mandrel; then reengaging the latch member with the catch member, and continuing to exert an upward longitudinal force until a predetermined amount of force has been applied to the latch member to cause the biasing means to move in a radial direction disengaging the latch member with the catch member. After this movement, the hammer will move rapidly and strike the anvil.

A feature of the present invention includes having the power mandrel connected to the workstring. Another feature is the grooved section of the operator mandrel which cooperates with the latch member. Another feature is the use of the collet to attach the mandrel and housing together.

Still another feature is use of the novel spring means for biasing the latch member. Yet another feature is the use of longitudinal slots about the cylinder of the spring means which provides the resiliency of the latch member.

An advantage of the present invention includes having a more predictable force requirement for detaching the latch member from the catch located on the collet. Another advantage is that the resiliency of the spring can be changed by manufacturing larger widths and longer slots of the spring member. Another advantage is that the resiliency of the spring can be adjusted by varying the length of the tines of the spring member. Still yet another advantage is the biasing means and latch may be of a maximum thickness such that the latch member and the biasing means will wear very little with repeated use.

Another advantage includes use of adjusting means disposed about both ends of the spring means to adjust the resiliency of the spring means. Yet another advantage includes the ability to reset the latch means by slacking off the workstring. Another advantage includes being able to reset multiple times without fatigue of the biasing means. Another advantage is the minimum number of parts that make-up the invention thereby making the invention an uncomplicated and workable invention that requires little field maintenance. Still yet another advantage is the stroke length of the jar is twenty inches.

DESCRIPTION OF THE PREFERRED EMBODIMENTS

Figure 1:
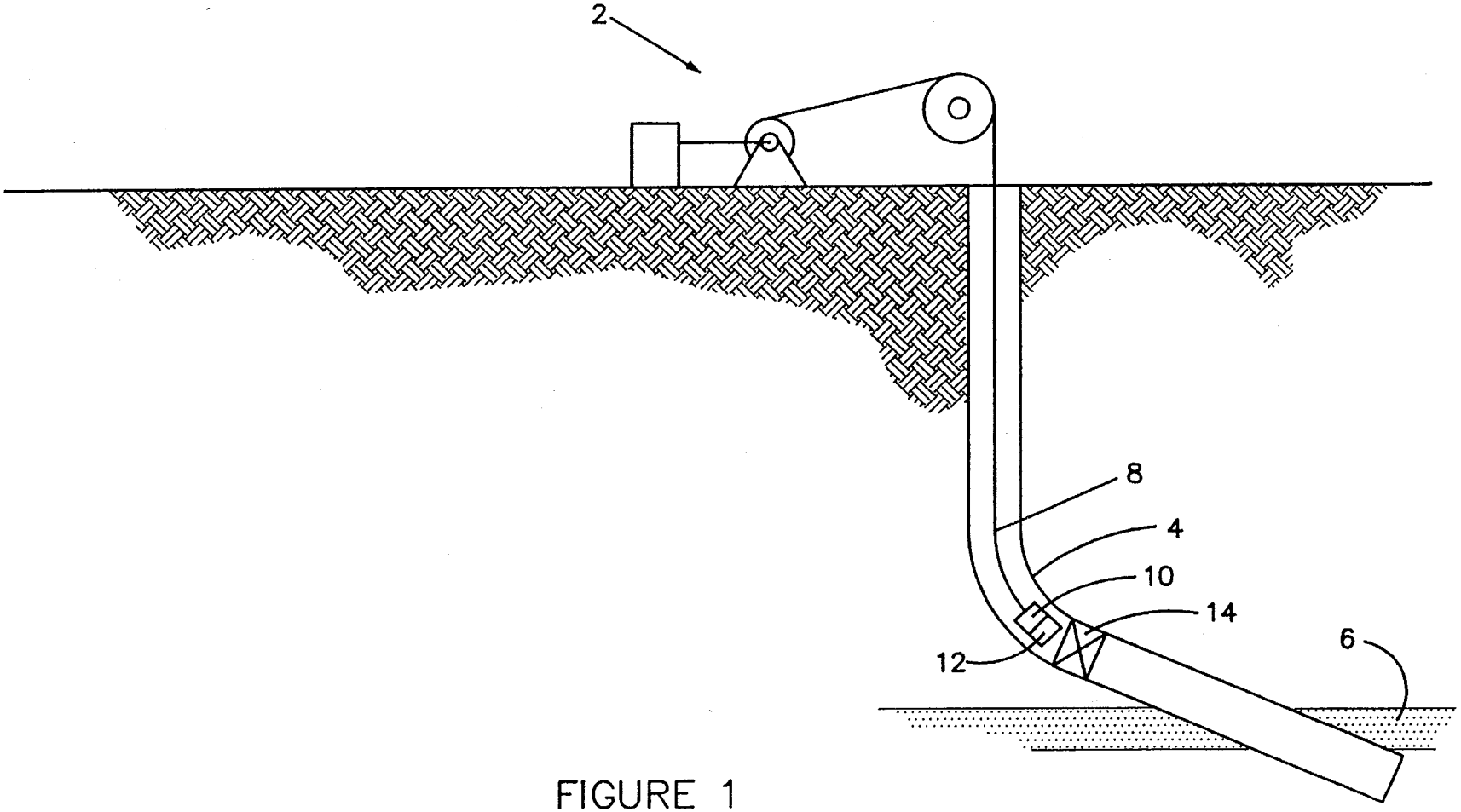
FIG. 1 is schematic of a typical wire line unit used for work in a wellbore.

Referring to FIG. 1, a typical wire line unit 2 is shown operating in a wellbore 4, which in the figure shown is a casing string as will be appreciated by those of ordinary skill in the art. The wellbore 4 will intersect an subterranean reservoir 6 that will contain hydrocarbons.

The wire line unit 2 will have extending therefrom a workstring 8 that will have attached thereto a bottom hole assembly 10. As seen in FIG. 1, the bottom hole assembly has attached thereto the jar apparatus 12 of the present invention. The jar apparatus will in turn be connected to an object, which may be a stuck object such as a packer. It should be understood that the apparatus of the present invention is applicable to various types of workstrings such as conventional drill pipe, as well as snubbing tubing, wireline, and electric line. Moreover, the apparatus may be used to provide a jarring impact to objects such as packers and setting tools.

Figure 2A:
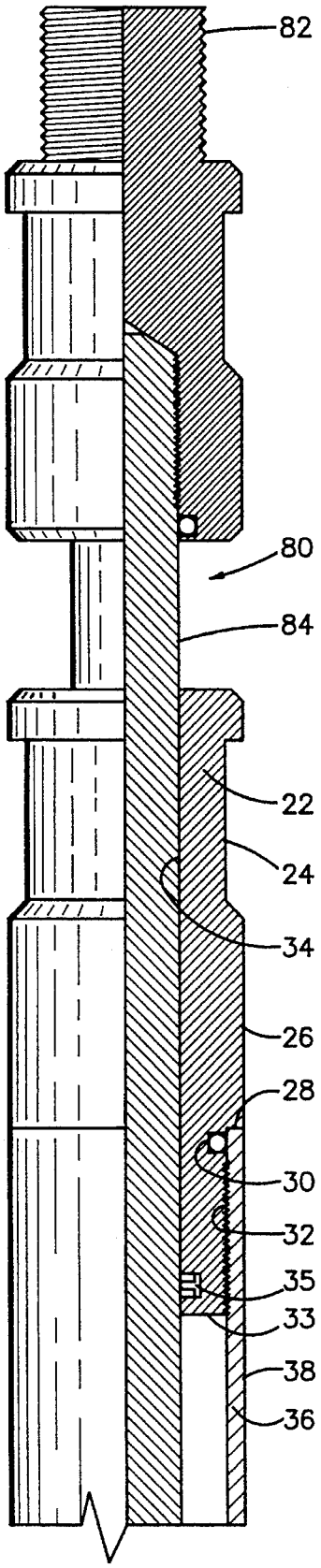
FIGS. 2A–2C are cut-away views of the apparatus of the present invention.
Figure 2B:
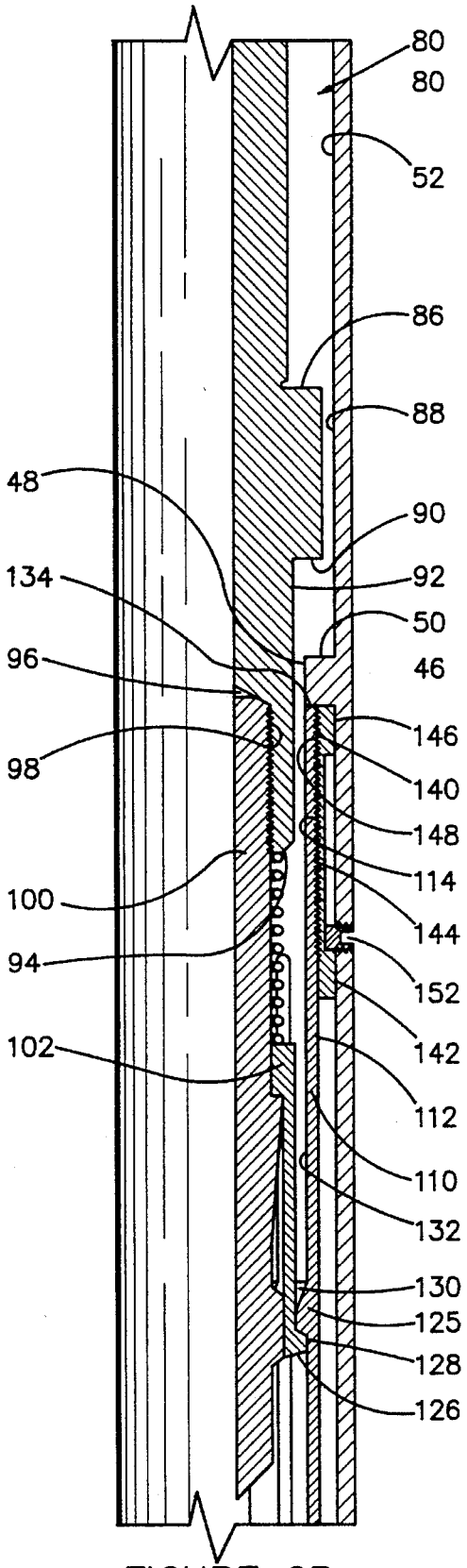
Figure 2C:
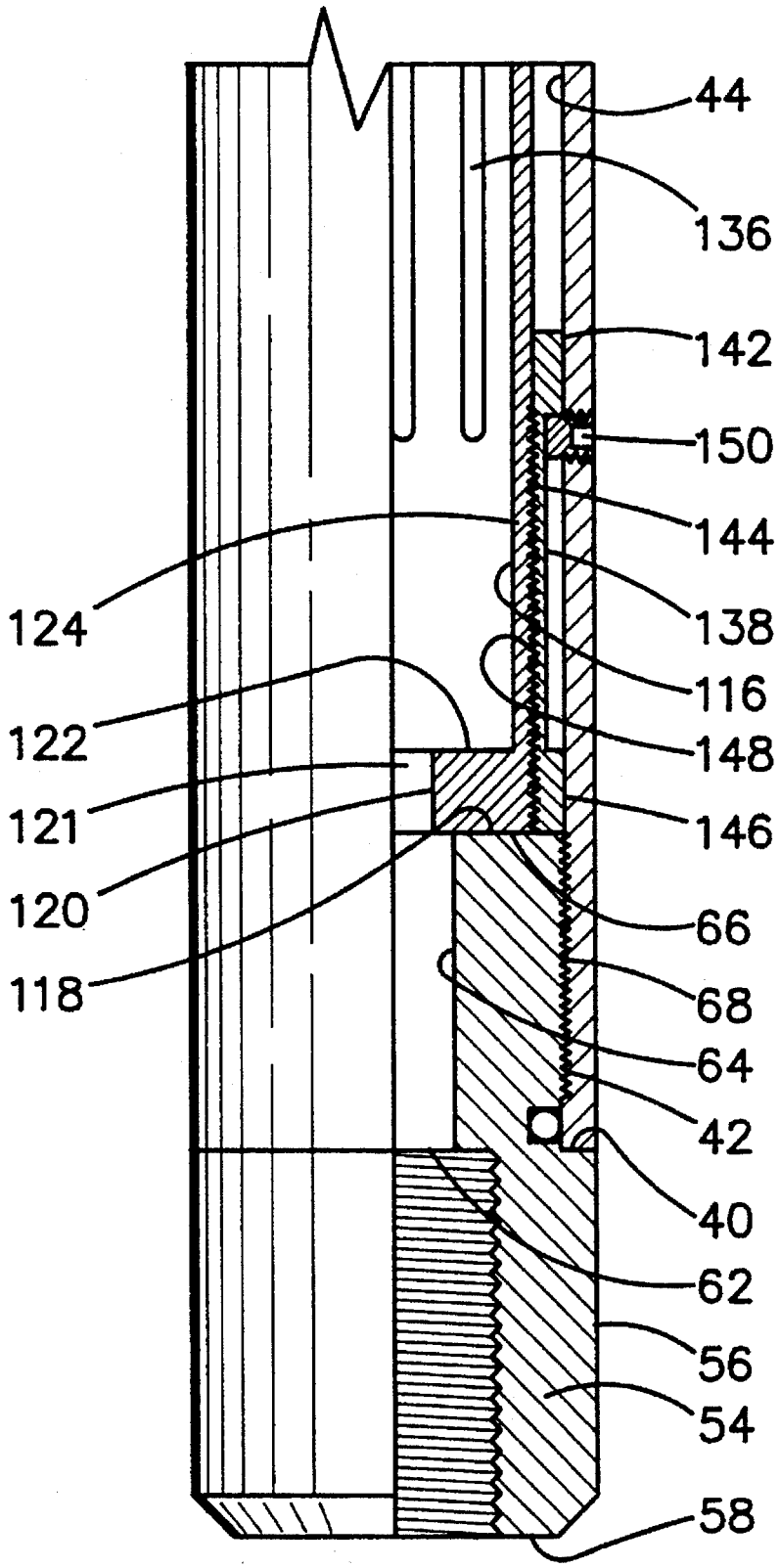

Referring now to FIGS. 2A–2C, the preferred embodiment of the present invention will now be described. It should be noted that the invention is applicable to workstrings such as coiled tubing. The apparatus will require only minor modifications from the embodiment shown in FIGS. 2A–2C such as a bore hole through the inner diameter of the mandrel. The cylindrical housing 20 comprises a first section 22 that is a fishing neck 22 that has a recessed surface 24, that leads to cylindrical surface 26, with cylindrical surface terminating at radial surface 28. The radial surface extends to the cylindrical surface 30, with the surface 30 having contained thereon external thread means 32 and concluding on anvil shoulder 33. The first section 20 contains an inner diameter portion 34 that contains "T" seal means 35.

The second section 36 of the cylindrical housing 20 will now be described. The second section 36 has a cylindrical outer body 38 that extends to the generally radial surface 40 which in turn extends to the internal thread means 42, with the thread means 42 stretching to the inner diameter bore 44. The bore 44 will terminate at the radial shoulder 46, that in turn extends to bore surface 48, that in turn extends to a second radial shoulder 50, that in turn extends to inner diameter bore 52.

The third section 54 of the cylindrical housing 20, as seen in FIG. 2C, includes and outer surface 56 that terminates at the radial shoulder 58, that in turn extends to internal threads 60. The threads 60 stretches to chamfered surface 62, which in turn leads to inner diameter bore 64 that concludes at radial shoulder 66, with the shoulder 66 extending to the external thread means 68.

The power mandrel, seen generally at 80 in FIG. 2A, will now be described. The power mandrel 80 will have external thread means 82 at the first end of the mandrel 80, with the external thread means 82 that extends to the cylindrical surface 84. The surface 84 extends to radial shoulder 86 that in turn terminates at the cylindrical surface 88 which in turn terminates at the radial shoulder 90 that extends to the cylindrical surface 92.

The surface 92 will conclude at the radial surface 94 with the radial surface 94 containing a cavity 96, with the cavity 96 containing internal thread means 98 that will be threadedly connected to the operator mandrel 100. The operator mandrel 100 will have disposed about it a collet member 102 that makes up a part of the attachment means for attaching the operator mandrel 100 to the cylindrical housing body 20. The operator mandrel 100 and the collet member 102 will be described in greater detail later in the application.

Referring now to FIG. 2B, the biasing means 110 will now be described. The biasing means comprises an outer cylindrical surface 112 that has contained thereon a first thread means 114 and a second thread means 116. The outer cylindrical surface 112 terminates at radial end 118, with the radial end 118 extending to the first inner rectangular surface 120, that will cooperate with a calibration key to be described later in the application, that in turn concludes at the radially flat surface 122 which in turn extends to the second inner cylindrical surface 124.

The inner cylindrical surface 124 concludes at the latch member 125 of the present invention which comprises an angled surface 126, with the chamfered shoulder extending to a longitudinal surface 128, which in turn stretches to the angled shoulder 130, that in turn concludes at the inner diameter cylindrical surface 132. The inner diameter cylindrical surface 132 will terminate at the radial end 134. The biasing means will have a series of longitudinal slots 136. As will be appreciated by those of ordinary skill in the art, the resiliency of the biasing means is dependent on the strength of the metal employed, the thickness of the member, the length of the slots, the number of slots, and the width of the slots. Furthermore, the amount of elastic movement and the force required therefore can be controlled by the spring adjustment means seen at generally 138 and 140.

Basically, the spring adjustment means 138 and 140 are identical in construction, and therefore, like numbers will refer to like components. The spring adjustment means 138, 140 consists of an outer cylindrical surface 142 that will extend to a recessed outer cylindrical surface 144 which in turn concludes at the outer cylindrical surface 146. Extending radially inward, the inner diameter surface will have contained thereon internal thread means 148 that will cooperate with the thread means 114,116 respectfully of the biasing means 110. Thus, by rotation of the either spring adjustment means (138, 140), the spring adjustment means 138, 140 will travel axially. This has the effect of reducing the resiliency of the biasing means 110 since the effective length of the longitudinal slots has been reduced. Therefore, the operator can control the amount of resiliency by simply rotating the spring adjustment means. As will be described hereinafter, the resiliency of the biasing means will control the amount of force to detach the latch from the collet member.

Disposed within the walls of the cylindrical housing 20 will be the retaining set screws 150 and 152. By having the retaining set screws 150 and 152, the movement of the spring adjustment means 138 and 140 will be limited when the operator is in the process of adjusting the proper tension of the biasing means 110. The setting of the tension by use of the spring adjusting means 138 and 140 will be described in detail during the description of FIG. 10.

Figure 3:
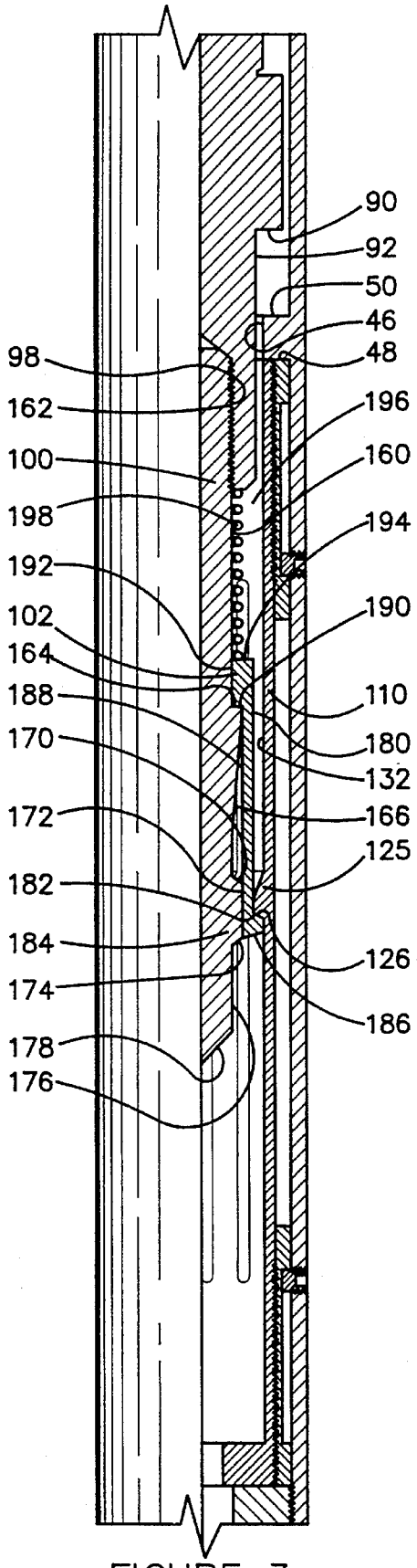
FIG. 3 is a partial cut-away view of the operator mandrel and collet member of the attachment means of the present invention.

Referring now to FIG. 3, the operator mandrel 100 and collet member 102 of the attachment means of the present invention will now be described. The operator mandrel 100 will comprise an outer cylindrical surface 160 that will have contained thereon external thread means 162 that cooperate with the thread means 98. The cylindrical surface 160 extends to the radially level surface 164, that in turn extends to the angled surface 166. The angled surface 166 stretches to a substantially cylindrical surface 168, that in turn will extend to the angled surface 170, that levels off to outer cylindrical surface 172. Therefore, the surfaces 166, 168, 170 and 172 define the groove or recess section of the operator mandrel.

The outer cylindrical surface 172 extends to the chamfered shoulder 174 which in turn extends to the cylindrical surface 176 that stretches to the conically shaped end 178.

The collet member 102 is slidably disposed about the operator mandrel 100. The collet member 102 comprises an outer cylindrical surface 180 that stretches to the angled surface 182, with the angle of surface 182 being complementary with and cooperating with the angled surface 126 of the latch member 125. The angled surface 182 will then conclude at the cylindrical outer surface 184 which in turn extends to radially angled surface 186. The inner diameter of the collet member 102 comprises an inner bore 188 that extends to radially flat shoulder 190 that rest on and cooperates with the radially level surface 164 of the operator mandrel 100. The shoulder stretches to the inner diameter bore 192 that in turn concludes at the radially level surface 194.

The area between the outer cylindrical surface 160 and the inner diameter cylindrical surface 132 defines a spring chamber 196 for placement of the spring 198.

With reference to FIGS. 4 through 9, the operation of the jarring apparatus will now be described. It should be noted that like numbers in the drawings refer to like components.

Figure 4:
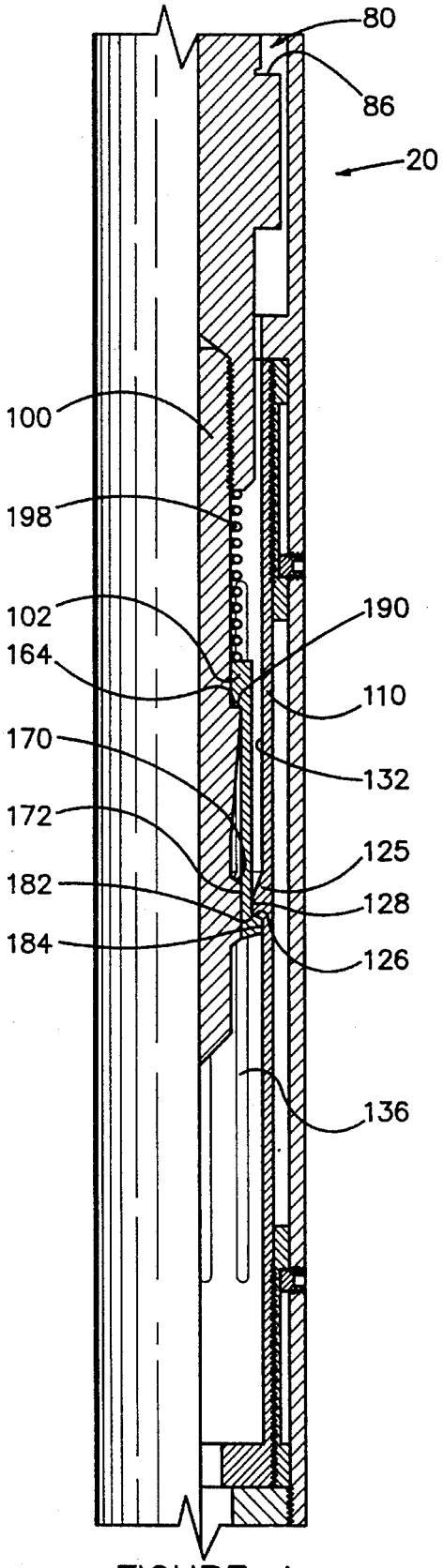
FIG. 4 is a cut-away view of the apparatus undergoing an upward longitudinal force.

Generally, the operator will have the jar apparatus 12 attached to a workstring, such as the coiled tubing string 8 depicted in FIG. 1. The thread means 82 of the power mandrel 80 will be attached to the workstring. In order to deliver an upward jarring impact, the operator will begin an upward pull of the workstring 8 which will thereby cause the operator mandrel 100 to be subjected to an upward longitudinal force. FIG. 4 depicts the dynamics of the apparatus 12 during this phase.

Thus, the angled surface 182 of the collet member 102 is abutted against the angled surface 126 of the latch member. As the operator mandrel 100 is continued to be pulled, the radially level shoulder 164 will transmit the force to the collet member 102 via radial flat shoulder 190.

Figure 5:
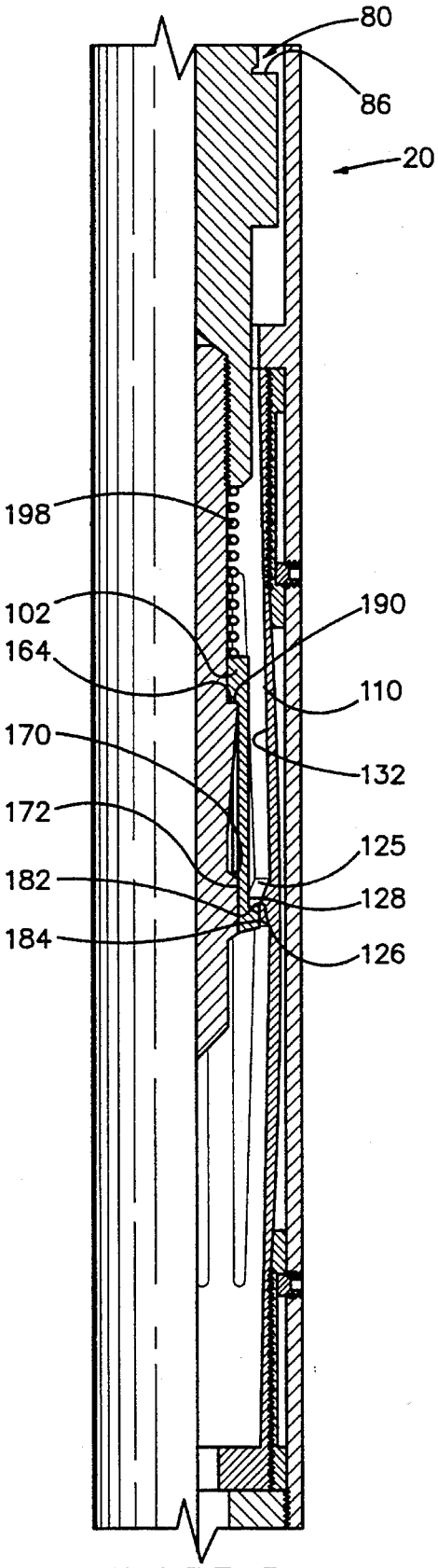
FIG. 5 is a partial cut-away view of the apparatus at the point of release of the detaching means.
Figure 6:
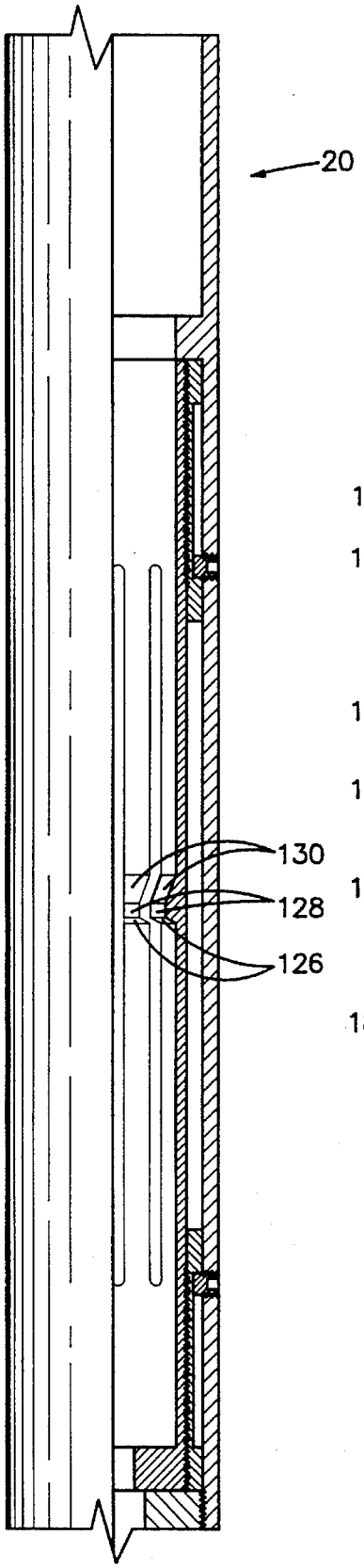
FIG. 6 is a partial cut-away view of the apparatus following a full stroke of the hammer means.

As illustrated in FIG. 5 and as the force is continued, the force will cause the latch member 125, and in particular the surface 126 to move axially so that the surfaces 184 and 128 are axially aligned. The axial movement is allowed because of the biasing means 110 being bowed outward as depicted in FIG. 5. Once the surfaces 184 and 128 are aligned, the jar will be released since there is no longer a mechanism latching the mandrel 100 and housing 20 together. Thus, the power mandrel 80 will be released as depicted in FIG. 6 allowing the radial shoulder 86 to travel rapidly and strike the anvil shoulder 33.

Figure 7:
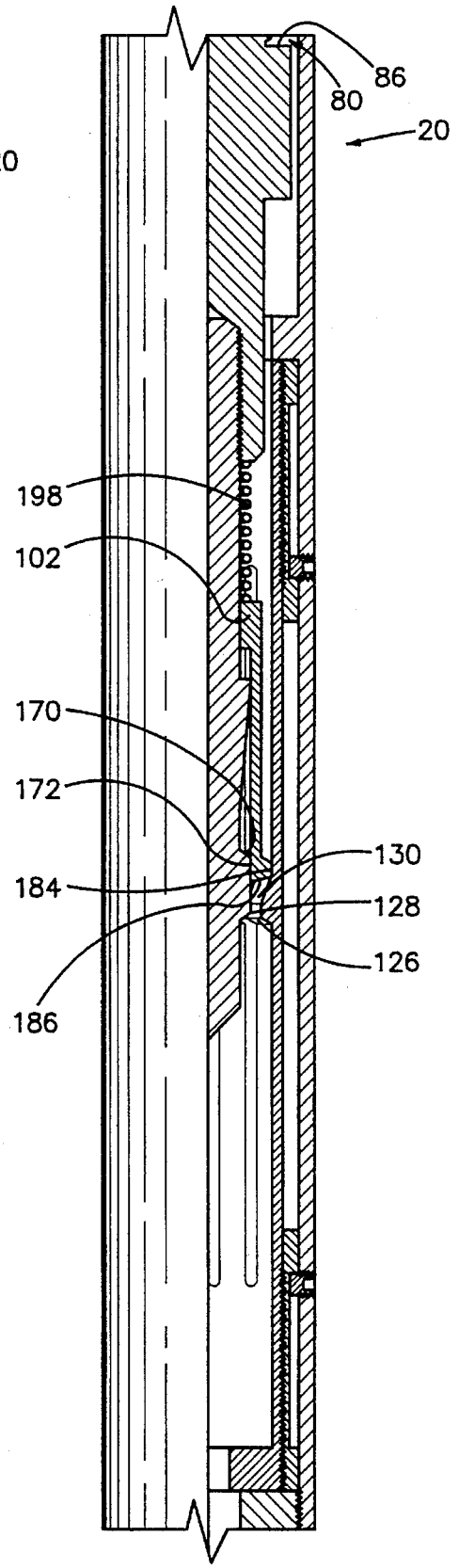
FIG. 7 is a partial cut-away view of the apparatus in the process of resetting.

In order to reset the jar 12, reference is made to FIG. 7. The operator will set down the weight of the workstring thereby causing the power mandrel 80 to move downward. This will in turn cause the operator mandrel 100 with the collet member 102 to travel downward until the radially angled surface 186 of the collet member 102 abuts the angled surface 130 of the latch member 125.

Figure 8:
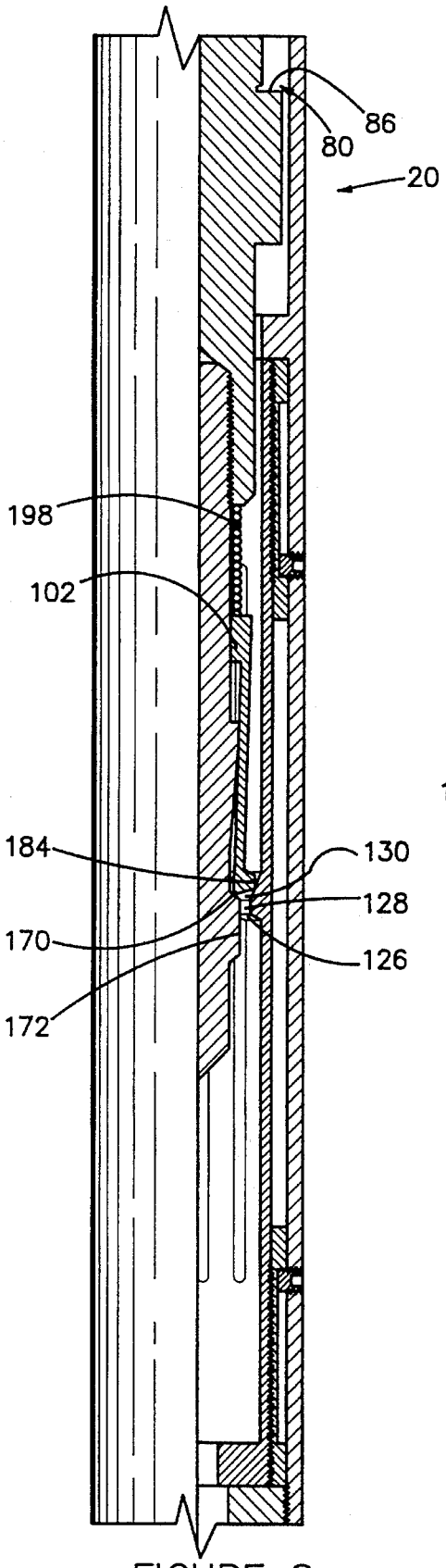
FIG. 8 is a partial cut-away view of the apparatus in the process of resetting.

As illustrated in FIG. 8 and in order to reset the jar 12, continued downward movement will result in the collet member 102 being wedged into the groove section of the operator mandrel by the collet member's abutment with the angled surface 170. Note, the position of the conical spring 198 in a retracted position as the power mandrel 80 is continued to be lowered.

Figure 9:
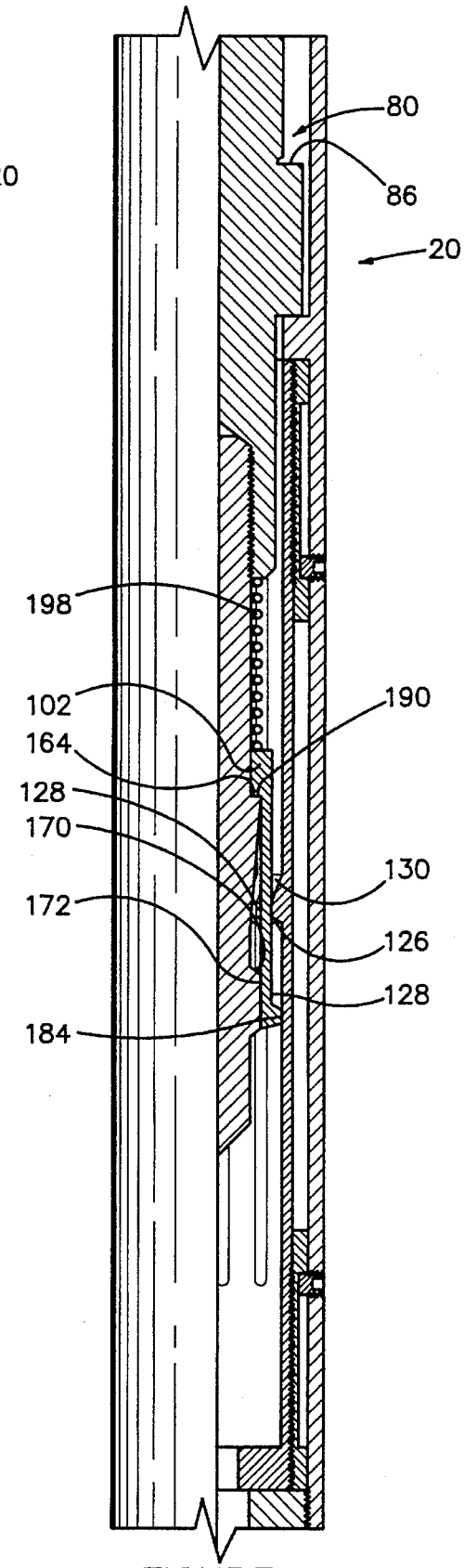
FIG. 9 is a partial cut-away view of the apparatus in the completed reset mode.

The operator will continue the lowering of the workstring, as depicted in FIG. 9, until the outer cylindrical surface 172 clears the longitudinal surface 128 of the latch member 125. During the lowering step, the spring 198 was continuing to urge the collet member 102 downward so that the radially angled surface 186 and cylindrical outer surface 184 of the collet member 102 pass the latch member 125. At this point, the spring means 198 will urge the collet member 102 such that the radial flat shoulder 190 of the collet member 102 abuts the radially level surface 164 of the operator mandrel 100.

In order to deliver another upward impact, the workstring is again raised so that the power mandrel 80 is moved upward. The upward movement will in turn cause the angled surface 182 of the collet member 102 to abut the angled surface 126 of the latch member 125, as shown in FIG. 4. Thereafter, the method of delivering the impact is the same as characterized in the description of FIGS. 4 through 6.

Figure 10:
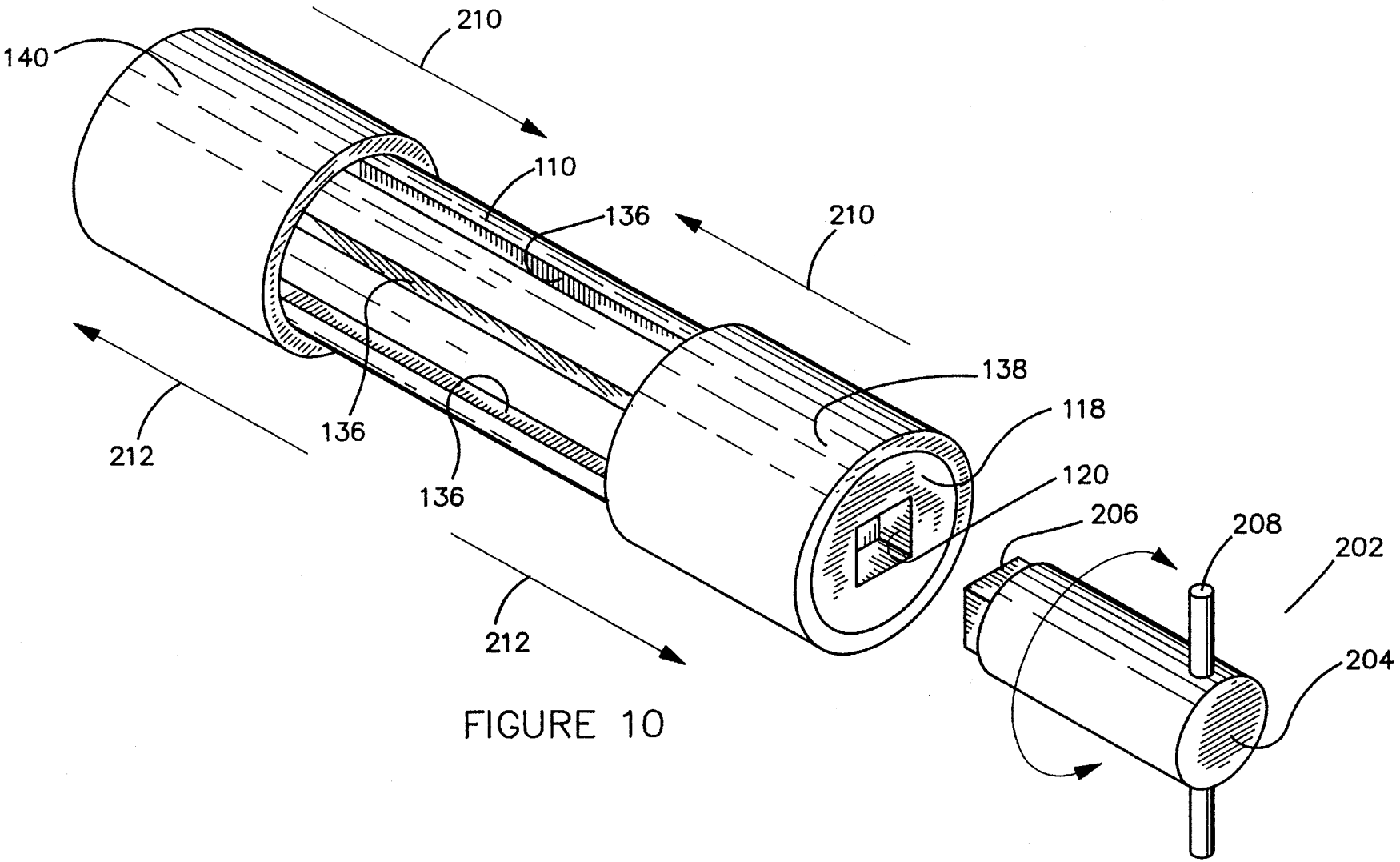
FIG. 10 is a schematic view of the calibration means of the present invention.

Referring now to FIG. 10, the illustration depicts the previously described biasing means 110 having contained thereon the longitudinal slots 136. The spring adjustment means 138 and 140 are disposed about each end of the biasing means 110, as has been previously set out. Also shown in FIG. 10 is the calibration key 202 that has a first cylindrical end 204 and a second rectangular end 206. The calibration key 202 may also contain handle means 208 so that the key can be conveniently turned in either a clockwise (right hand) rotation or counter-clockwise (left hand) rotation.

In operation of the calibration means 202, the calibration key 202, and in particular the rectangular end 206, is inserted through the passage 121 formed from surfaces 120, as seen in FIG. 2C. By turning the key 202 in a clockwise fashion, the biasing means 110 will be held static because of the retaining set screws 150, 152 which in turn cause the spring adjustment means 138, 140 which are threadedly connected with the biasing means 110, to travel in a direction denoted by arrows 210. The direction 210 will have the effect of shortening the effective length of the longitudinal slots 136 thereby reducing the movement of the latch member 125 in response to a force i.e. requiring greater force to cause bending of the biasing means 110.

Likewise, with a counter-clockwise rotation, the biasing means 110 will also be held static by the retaining set screws 150, 152 which in turn will cause the spring adjustment means 138, 140, which are threadedly connected with the biasing means, to travel in a direction denoted by arrows 212. The direction 212 will have the effect of lengthening the longitudinal slots 136 thereby increasing the movement in response to a force i.e. requiring lesser force to cause bending of the biasing means 110.

The retainer set screw 150 will prevent rotation of the biasing means 110, and also prevent the spring adjustment means 138 from backing out when the calibration key 202 is turned in a counter-clockwise fashion as well as preventing further movement when the key is turned in the clockwise rotation. The retainer set screw 152 will prevent rotation of the biasing means 110, and also prevent the spring adjustment means 140 from a preset further movement when the key 202 is turned in clockwise rotation.

Changes and modifications in the specifically described embodiments can be carried out without departing from the scope of the invention which is intended to be limited only by the scope of the appended claims.

I claim:

1. An apparatus for delivering a jarring action to a stuck object in a wellbore comprising:

a cylindrical housing, said cylindrical housing being connected to the stuck object;

a power mandrel disposed within said cylindrical housing, said mandrel being threadedly connected to a workstring;

selective connecting means for selectively connecting said housing with said power mandrel;

wherein said selective connecting means comprises:

a latch member;

biasing means for biasing said latch member in a first direction, and wherein said biasing means contains a tubular member disposed within said cylindrical housing, said tubular housing having a plurality of longitudinal slots, with said latch member being formed integrally on said tubular housing;

an operator mandrel threadedly engaged with said power mandrel, said operator mandrel containing an indentation;

a collet member disposed about said operator mandrel, said collet member having a catch member, with said catch member engaging said latch member;

collet spring means, disposed about said operator mandrel, for urging said collet member into a first position, said first position representing the engaged position of said latch member with said catch member; and, biasing adjustment means for adjusting the tension of said biasing means so that said latch member is urged into contact with said catch member at variable levels of force.

2. The apparatus of claim 1 wherein said biasing adjustment means includes:

a first cylindrical member disposed about the first end of said tubular member; and a second cylindrical member disposed about the second end of said tubular member.

3. The apparatus of claim 2 further comprising:

calibration means for calibrating the tension of said biasing means.

4. An apparatus for providing a jarring action to an object in a wellbore comprising:

a body member having an inner and outer diameter;

an operator mandrel slidably disposed within the inner diameter of said body member, wherein said operator mandrel contains a groove section;

selective attachment means for selectively attaching and detaching said operator mandrel to said body member, said selective attachment means comprising: a latch member; a collet member slidably disposed about said operator mandrel, said collet member containing a catch member that cooperates and engages with said latch member; and, spring means, connected to said latch member, for urging said latch member into attachment with said catch member;

resetting means, located on said operator mandrel, for resetting said operator mandrel with said body member when the operator mandrel has been detached from said body member;

and wherein said body member contains a first end and a second end, and wherein said second end is connected to the object in the wellbore, and said operator mandrel is connected to a workstring capable of transmitting a longitudinal force to said operator mandrel and wherein said resetting means comprises said groove section being sized to accommodate said catch member of said collet member when the operator mandrel has been detached from said body member.

5. The apparatus of claim 4 wherein said spring means includes:

a tubular member disposed within said cylindrical housing, said tubular housing having a plurality of longitudinal slots, with said latch member being attached to said tubular housing.

6. The apparatus of claim 5 wherein said spring adjustment means includes:

a first cylindrical member disposed about the first end of said tubular member; and a second cylindrical member disposed about the second end of said tubular member.

7. The apparatus of claim 6 wherein said the first end of said biasing means contains a rectangular opening, and the apparatus further comprises:

a calibration key having a rectangular shaped first end, with the first end of said calibration key cooperating with said first end of said biasing means so that rotation of said first and second cylindrical members adjust the tension in said biasing means.

8. A method of delivering a jarring force to an object in a wellbore comprising the steps of:

lowering into the wellbore a coiled tubing workstring, said workstring containing a jarring apparatus, said apparatus containing:

a cylindrical housing, said cylindrical housing having a first end capable of engaging said object, and said cylindrical housing further having a shoulder providing an anvil surface;

a power mandrel disposed within said cylindrical housing, said mandrel being threadedly connected to the workstring, said power mandrel containing a section having a reduced outer diameter;

means for selectively connecting said housing with said operator mandrel, said selective means comprising;

a latch member;

biasing means for biasing said latch member in a first direction;

a collet member slidably disposed about said operator mandrel, said collet member having a catch member, with said catch member engaging said latch member;

engaging said object with said first end of said housing;

exerting an upward longitudinal force on said workstring so that the force is transmitted to said power mandrel;

engaging said latch member and said catch member;

continuing to exert a longitudinal force until predetermined amount of force has been applied to said latch member to cause said biasing means to move in a radial direction disengaging said latch member with said catch member;

impacting said hammer with said anvil;

lowering the workstring so that said catch member engages said latch member; and, exerting a downward force so that said catch member is guided into said reduced diameter portion on said power mandrel.

9. The method of claim 8 further comprising the steps of:

exerting an upward longitudinal force on said workstring so that the force is transmitted to said power mandrel;

engaging said latch member with said catch member;

continuing to exert a longitudinal force until a predetermined amount of force has been applied to said latch member to cause said biasing means to move in a radial direction disengaging said latch member with said catch member;

impacting said hammer with said anvil.

* * * * *